United States Patent [19]

Zarchy

[11] Patent Number: 4,831,208

[45] Date of Patent: May 16, 1989

[54] CHEMICAL PROCESSING WITH AN OPERATIONAL STEP SENSITIVE TO A FEEDSTREAM COMPONENT

[75] Inventor: Andrew S. Zarchy, Amawalk, N.Y.

[73] Assignee: UOP, Des Plains, Ill.

[21] Appl. No.: 121,904

[22] Filed: Nov. 17, 1987

Related U.S. Application Data

[63] Continuation-in-part of Ser. No. 22,136, Mar. 5, 1987, abandoned.

[51] Int. Cl.[4] ..... C07C 5/13

[52] U.S. Cl. ..... 585/737; 208/60; 208/120; 208/89; 208/91; 208/301; 208/302; 208/303; 208/133; 502/517; 502/34; 423/575; 423/573.1; 55/74; 55/75; 585/822

[58] Field of Search ..... 208/60, 120, 89, 301, 208/302, 303, 191; 502/517, 34; 423/573 R, 575; 55/74, 75; 585/737, 822

[56] References Cited

U.S. PATENT DOCUMENTS

| | | | |
|---|---|---|---|
| 2,897,141 | 7/1959 | Honeycutt et al. | 208/89 |
| 2,899,378 | 8/1959 | Herder | 208/89 |
| 2,937,215 | 5/1960 | Bleich et al. | 208/91 |
| 2,951,888 | 9/1960 | Carr | 585/737 |
| 2,951,993 | 2/1961 | Kimberlin, Jr. et al. | 585/737 |
| 2,969,316 | 1/1961 | Stanford et al. | 208/89 |
| 3,063,933 | 11/1962 | Meiners | 208/91 |
| 3,063,934 | 11/1962 | Epperly et al. | 208/91 |
| 3,069,349 | 12/1962 | Meiners | 585/737 |
| 3,109,804 | 11/1963 | Martin | 208/89 |
| 3,384,576 | 5/1968 | Greco | 208/89 |
| 3,395,095 | 7/1968 | Child et al. | 208/89 |
| 3,404,539 | 11/1968 | Paterson | 208/60 |
| 3,497,448 | 2/1970 | Hamner et al. | 208/60 |
| 3,506,733 | 4/1970 | Mayhue | 585/737 |
| 3,540,998 | 11/1970 | Berck et al. | 585/737 |
| 3,620,969 | 11/1971 | Pittain | 502/517 |
| 3,806,443 | 4/1974 | Maziuk | 208/60 |
| 3,867,276 | 2/1975 | Berger | 208/60 |
| 3,884,798 | 5/1975 | Alley, Jr. et al. | 208/89 |
| 3,898,153 | 8/1975 | Lander et al. | 208/89 |
| 3,899,543 | 8/1975 | Cosyns et al. | 208/89 |
| 3,930,986 | 1/1976 | Berger | 208/60 |
| 3,933,619 | 1/1976 | Koztowski | 208/74 |
| 3,957,621 | 5/1976 | Bonacci et al. | 208/74 |
| 4,127,471 | 11/1978 | Suggitt et al. | 208/62 |
| 4,179,399 | 12/1979 | Lichtenberger et al. | 502/517 |
| 4,317,808 | 3/1982 | Voigt et al. . | |
| 4,358,297 | 11/1982 | Eberly, Jr. . | |
| 4,533,529 | 8/1985 | Lee | 423/230 |
| 4,592,829 | 6/1986 | Eberly, Jr. | 502/517 |
| 4,634,515 | 1/1987 | Baily et al. | 208/60 |
| 4,737,164 | 4/1988 | Sarkkinen . | |

FOREIGN PATENT DOCUMENTS

| | | | |
|---|---|---|---|
| 926332 | 5/1973 | Canada | 208/60 |
| 2506336 | 10/1975 | Fed. Rep. of Germany | 208/60 |
| 1254185 | 11/1971 | United Kingdom | 208/60 |

*Primary Examiner*—H. M. S. Sneed
*Assistant Examiner*—Helane Myers
*Attorney, Agent, or Firm*—Morris N. Reinisch

[57] ABSTRACT

The present invention relates to a chemical process involving a processing step which is sensitive to the presence of at least one component contained within the stream to be processed and to an economical and efficient method of temporarily removing such deleterious component from the stream so as to have the deleterious component by-pass the step which is sensitive to this component using an adsorbent for such removal wherein the adsorbent is regenerated by the product effluent stream leaving the sensitive processing step.

22 Claims, 2 Drawing Sheets

CHEMICAL PROCESSING WITH AN OPERATIONAL STEP SENSITIVE TO A FEEDSTREAM COMPONENT

CROSS-REFERENCE TO RELATED APPLICATIONS

This application is a continuation-in-part of application Ser. No. 022,136, filed Mar. 5, 1987 now abandoned, the contents of which is hereby incorporated by reference.

BACKGROUND OF THE INVENTION

1. Field of the Invention

This invention pertains to the field of chemical processing. More particularly, the present invention relates to a chemical process involving a processing step which is sensitive to the presence of at least one component contained within the stream to be processed and to an economical and efficient method of temporarily removing such deleterious component from the stream so as to have the deleterious component by-pass the step which is sensitive to this component.

2. Discussion of Related Art

There are many chemical processes in which there is at least one processing step which is sensitive to at least one component contained within the original feedstream to the process or to a component which is generated within the process upstream of the sensitive step. Generally, the presence of such a step will necessitate the removal of all or most of the deleterious component prior to its being introduced into the sensitive processing step.

These sensitive processing steps may include essentially all aspects of unit operations involved in chemical engineering practice. Thus, there are many chemical processes which cannot tolerate the presence of particular constituents which may be contained within the feedstream. For example, one such process involves the use of membranes for separating methane from natural gas where the presence of condensibles, such as pentane, hexane, or the like, would be detrimental to the membrane. So too, in those chemical reactions where a catalyst is employed, such catalyst is typically sensitive to various chemical constituents as well. Such sensitive catalysts include, for example, an iron oxide catalyst which is used for the formation of ammonia and which is particularly sensitive to carbon oxides. Without the removal of these deleterious components from the reaction zone, the catalyst will be poisoned, the reaction will not proceed, or proceed very poorly, or totally undesirable side reactions will take place.

Chemical reactions are not the only place in which the presence of certain components causes detrimental results. Thus, when using ion exchange resins, for example, it is frequently necessary to remove certain components from the stream to be processed prior to its being introduced into the ion exchanger. The presence of certain components within the feedstream could very well interfere with the ion exchange process or even destroy its utility completely. More specifically, in ion exchanging water to replace calcium ions with potassium ions, for example, the presence of sodium ions within the fluid stream would be detrimental to the ion exchange process requiring that the sodium ion be removed upstream of the process.

Even in certain distillation steps, particularly during azeotropic distillation, the presence of certain components within the fluid stream to be processed may be deleterious to the successful separation of the azeotropic solution. Again, this necessitates the removal of these constituents prior to the distillation step. The same holds true for still other unit operations, such as, irreversible adsorption when using zinc oxide, for example, and the like.

No matter which sensitive processing step is involved, it is readily apparent that steps must be and are taken to remove the deleterious components from the stream prior to such stream entering the sensitive step.

There may be situations, however, in which the deleterious component is not at all detrimental in the final product. Yet, because of the at least one sensitive step within the process, means must be taken to remove this component, usually at considerable outlay of capital cost for the necessary removal equipment and at increased overall operating expense.

Moreover, regardless of the means used to remove the deleterious component from the stream to be processed, it is still then necessary to deal with this removed component within the removal means. Thus, for example, when utilizing a solid adsorbent of the oxide type for the removal of the deleterious component, typically sulfide compounds, such an adsorbent is not readily regenerable. Hence, it is necessary to constantly replenish this adsorbent at considerable cost as well as deal with the ultimate disposal of the sulfide-laden oxide.

When fluid streams are utilized to remove the deleterious component, these streams too must then be regenerated for continued use requiring yet additional streams for such regeneration. Not only does this add to the cost of the overall process but there must also be a sufficient supply of such regenerating fluid as well. This is particularly true when using regenerable adsorbents such as molecular sieves. In order to desorb the deleterious component from the adsorbent, there must be a readily available supply of purge gas which must also be at the proper regenerating temperature. This is not always feasible at a particular plant site. Correspondingly, once the adsorbent has been regenerated with the purge gas, the purge gas, now laden with the deleterious component, must still be dealt with. Flaring of this purge gas is not always feasible or desirable.

One particularly prevalent deleterious component is sulfur and its compounds. Sulfur occurs in many industrial processes, and such sulfur, or sulfur containing compounds, must frequently be removed from process streams for various reasons. For example, if the process stream is to be burned as fuel, removal of sulfur from the stream may be necessary to prevent environmental pollution. Alternatively, if the process stream is to be treated with a catalyst, removal of the sulfur is often necessary to prevent poisoning of sulfur-sensitive catalysts.

A variety of methods are available to remove sulfur from a process stream. Most sulfur removal techniques involve the treatment of a gaseous stream. Such techniques include the use of alkaline reagents or an amine solution to remove sulfur or sulfur components from such gaseous streams. Alternatively, molecular sieves or other sorbents may be used such as a particulate oxide, hydrated oxide, or hydroxide of alumina, zinc, iron, nickel, cobalt, or the like, alone or in admixture with each other or with yet additional materials, e.g., alkali or alkaline earth metal oxides and the like. Reference is made to U.S. Pat. No. 3,492,038 which describes processes using such oxides. The use of molecular sieves as a sulfur removal adsorbent is discussed in, for example, U.S. Pat. Nos. 3,024,868, 4,358,297 and 4,533,529.

In general, however, solid adsorbents of the oxide type are not readily regenerable to their original form and must be discarded when they have become completely sulfided.

With molecular sieves, it is necessary to purge these sieves with a heated gas in order to desorb the sulfur components and regenerate them. The feasibility of such regeneration is in many instances limited by the quantity of gas available at a plant site for use as a hot purge gas.

One particular industrial process which requires the removal of both sulfur and nitrogen bearing compounds from the feed stream due to the use of sulfur-sensitive and nitrogen-sensitive materials within the process is the isomerization of a hydrocarbon feedstream containing at least five carbon atoms, particularly light straight run gasoline or light naphthas. Such a feed typically contains sulfur bearing compounds on the order of about 200 ppm of sulfur and nitrogen bearing compounds on the order of about 0–10 ppm. As used herein, the term "sulfur" is meant to include sulfur and sulfur bearing compounds and the term "nitrogen" is meant to similarly include nitrogen as well as nitrogen bearing compounds. Such levels of sulfur and/or nitrogen generally adversely affect the performance and life of the isomerization catalyst. Consequently, such a feed is conventionally treated by a hydrodesulfurization step to remove the sulfur and any nitrogen contained therein upstream of the isomerization step.

Such a hydrodesulfurization step generally involves a furnace heater to vaporize the feed stream, a hydrotreating reactor which catalytically converts the sulfur and any nitrogen present in the feed to hydrogen sulfide and ammonia, respectively, a condenser in which about 30 to 40% of the gaseous hydrogen sulfide and ammonia is condensed along with the feed with the remainder of the hydrogen sulfide and ammonia leaving as overhead, and a steam stripper column wherein the condensed hydrogen sulfide and ammonia contained within the feed is removed. In lieu of the steam stripper, a hydrogen sulfide and ammonia adsorption bed may also be used wherein the feed stream would have to be cooled to the proper temperature prior to entering the adsorber.

Regardless of whether a steam stripper or an adsorber is utilized to remove the hydrogen sulfide and/or ammonia, the hydrocarbon stream, now having essentially all of its sulfur and nitrogen content removed, must then be reheated to convert it to a vapor once again prior to being introduced to the isomerization reactor.

While such a hydrodesulfurization technique for sulfur and nitrogen removal is an effective means for dealing with the presence of sulfur and nitrogen, it is extremely costly. In fact, the conventional practice is to run the hydrodesulfurization (also known as hydrotreating) unit separately and independently from the isomerization unit which clearly adds to the complexity of the process and the overall costs. So too, the necessity of repeatedly having to heat and cool the feed stream so as to effect a phase change to accommodate different process steps also adversely affects the economics and efficiency of the overall process.

This is but one example in which a need clearly exists to be able to effectively remove at least one deleterious component from a feed stream in an industrial process which contains a step which is sensitive to this at least one component in an economical and efficient manner.

SUMMARY OF THE INVENTION

Applicant has discovered a process for removing a deleterious component from a fluid stream so as to have the deleterious component by-pass a step contained within the process which is sensitive to this component in an economical and efficient manner which avoids substantially all of the disadvantages noted above.

More particularly, Applicant's process involves a totally new and unique approach to the use of adsorbents in which the stream being processed and containing a deleterious component is first passed through an adsorption zone containing a solid adsorbent capable of selectively adsorbing the deleterious component as compared to the remaining components contained within the stream under adsorption conditions. The stream, now containing a reduced concentration of the deleterious component, then proceeds to the remaining process steps ultimately passing through the step which is sensitive to the deleterious component producing a product effluent. At least a portion of this product effluent (as opposed to any waste stream leaving the sensitive processing step) is then ultimately utilized as a purge gas for the regeneration of the adsorbent bed, now laden with the deleterious component, under desorption conditions to provide a product effluent having an increased concentration of the deleterious component.

Accordingly, by virtue of the present invention, it is now possible to carry out a chemical process containing a step sensitive to a particular component in a very efficient and economical manner. Thus, as long as there is an adsorbent capable of selectively removing one or more components from a fluid stream, such an adsorbent can now be utilized in the process of the present invention where instead of using an externally provided purge stream or being limited to using waste streams produced in the process for the regeneration of such adsorbent and being correspondingly faced with the problems of adequate supply and disposal of this regenerating stream once it has been used for regeneration purposes, the process of the present invention provides for the elegant solution of actually utilizing the product stream itself as a purge stream once the sensitive step of the process has been carried out absent the presence of the detrimental component. This is particularly advantageous where it is desired to have the deleterious component present in the product stream.

One specific example in which it is particularly advantageous to have the deleterious component be present in the product effluent is in the process for preparing acrylic acid. Such a process generally involves the reaction of propylene with oxygen in the presence of a sulfur-sensitive catalyst. Due to the substantially similar boiling points of the propylene and the sulfur bearing compounds such as hydrogen sulfide, carbonyl sulfide, and the like, it has generally been quite difficult and expensive to remove the deleterious sulfur compounds. By virtue of the present invention, however, the feedstream containing the propylene and sulfur compounds can now be passed into an adsorbent which is selective for the sulfur compounds as compared to the propylene. The propylene, now essentially free of the sulfur compounds, is then reacted with oxygen to form the acrylic acid product effluent. This product effluent is then used to regenerate the adsorbent and desorb the sulfur bearing compounds from the adsorbent. Now, however, instead of having the combination of propylene and sulfur compounds, a combination of acrylic acid and sulfur compounds exists. Because there is a difference of about 200° F. between the boiling points of the acrylic acid and the sulfur bearing compounds, respectively, it is now quite a simple matter to separate one constituent from the other, all made possible by this invention.

Furthermore, as a still further advantage of the present invention, inasmuch as the sensitive step of the process will generally involve the use of higher temperatures, once the fluid stream passes through this step absent the deleterious component, the effluent from this step will typically be at a temperature which is generally desirable for the desorption of the adsorbent. Consequently, when the effluent is returned to the adsorption bed to be used as a purge stream for regeneration, it will usually not be necessary to expend the costs of heating this effluent stream, resulting in yet an additional economical savings.

As a practical matter, in order to provide for continuity of the adsorption step, at least two adsorption zones are utilized, at least one such zone for adsorption and at least one of the other zones for desorption. These zones are switched or cycled in service at intervals that would preclude breakthrough of the adsorbed deleterious component. In this manner, a fluid feedstream containing one or more deleterious components can continuously flow to an adsorption zone, the effluent from which can flow continuously to at least the sensitive step of the process and at least a portion therof be passed continuously to a desorption zone. At the proper point in time, that is, when the adsorption zone is substantially laden with the deleterious component and before there is any breakthrough, the adsorption zone in switched to become a desorption zone and the desorption zone is switched to become an adsorption zone in conjunction with the proper switching of the fluid feedstream flow path.

It is to be understood that in the present invention, it is not necessary to have the effluent leaving the adsorption step immediately be subjected to the sensitive processing step, or that immediately after the sensitive processing step, the thusly treated stream immediately be utilized, in whole or in part, as a desorption or purge medium. Indeed, there may be one or more process steps that are carried out on the adsorption effluent prior to its being introduced into the sensitive step of the process and/or there may also be one or more processing steps carried out on the material discharged from the sensitive step prior to its being used, in whole or in part, as the desorption or purge medium.

After desorption, if desired, the product effluent now once again containing deleterious component, may be treated by any conventional means for its removal.

Still further, as yet an additional advantage of the present invention, due to the cyclic nature of operating the adsorbent beds in conjunction with the use of the feedstream as a purging medium, Applicant has also discovered that it is now possible to utilize adsorbents at adsorption conditions which heretofore were thought totally impracticable due to their having a very low capacity at such conditions.

More specifically, most adsorbents are utilized at low temperatures during adsorption and at high temperatures for regeneration. By virtue of the present invention, it is possible to operate the adsorption bed even at high temperatures, temperatures which are conventionally used for regeneration, by cycling the adsorption/-desorption phases of the cycle at frequent enough intervals to prevent breakthrough. As a result of this ability to utilize the adsorbent at both high or low temperatures, it is no longer necessary to provide additional means and to expend the concomitant costs for lowering the temperature of a feedstream just to accommodate the optimum temperature of the adsorbent's removal characteristics.

Accordingly, in its most broadest embodiment, the present invention may be characterized as follows:

A process for performing an operation involving at least one component of a fluid stream to provide product containing said at least one component or a chemical derivative thereof, said fluid stream containing at least one other component which is deleterious in at least one step of the operation, comprising:

(a) contacting the fluid stream with adsorbent selective for the adsorption of the at least one other component as compared to the at least one component under adsorption conditions to provide an adsorption stage effluent having a reduced concentration of the at least one other component;

(b) using the adsorption stage effluent in the at least one step of the operation to provide a product effluent stream; and (c) contacting at least a portion of the product effluent stream with adsorbent having the at least one other component adsorbed thereon under desorption conditions to regenerate the adsorbent and provide a desorption stage effluent containing an increased concentration of the at least one other component.

In a more specific embodiment of the present invention, Applicant's process involves a novel approach to the use of hydrogen sulfide adsorbents wherein the sulfur content of the hydrocarbon feed stream is first catalytically converted into hydrogen sulfide and then the entire feed stream, while in the vapor state and at a high temperature, is passed through an adsorption zone containing a solid adsorbent selective for the adsorption of hydrogen sulfide as compared to the hydrocarbon feed thus providing a hydrocarbon feed having reduced hydrogen sulfide content. The sulfur-reduced hydrocarbon feed stream is then passed through the sulfur-sensitive step of the process, typically a catalytic reaction zone. The resulting hydrocarbon product effluent is then used as the purge gas for regenerating the sulfur-laden adsorption bed.

Unlike the prior art hydrogen sulfide adsorption techniques where vaporous or liquid sulfide-containing hydrocarbon feeds are passed through the adsorption zone at relatively low temperatures, generally in the range of from about 60° to 200° F., in the present invention, vaporous sulfide-containing hydrocarbon feed is passed through the adsorption zone at high temperatures which are well above the dew point of the feed stream, generally in the range of from about 250° to 600° F., temperatures which ordinarily are used in the prior art only for desorption of the hydrogen sulfide from the adsorbent with a purge gas.

Quite unexpectedly, Applicant has discovered that it is possible to effectively utilize hydrogen sulfide adsorbents while the feed is at a high temperature despite the fact that it is well known to those skilled in the art that such hydrogen sulfide adsorbents have low capacity for removing hydrogen sulfide at such high temperatures. Specifically, Applicant has found that by frequently cycling the adsorbents from adsorption to desorption and back again, particularly where the feedstream is utilized as the purging medium, it is indeed possible to utilize these adsorbents at high temperatures. Thus, in a conventional hydrogen sulfide adsorption step, an adsorption bed may be on the adsorption mode in the range of from about 8 to 24 hours. In the present invention, the hydrogen sulfide adsorption lasts for only abut 0.5 to 6.0 hours before the bed is switched to the desorption mode.

One of the many advantages of this specific embodiment of the present invention is the ability to carry out the desulfurization of the feed stream at high temperatures thereby eliminating the need for gas compressors, heaters and coolers and their concomitant costs which are required in the prior art hydrogen sulfide adsorption techniques. Here, in the present invention, after converting the sulfur present in the feed stream to hydrogen sulfide, the feed stream may immediately be passed through the adsorption zone and then on to a sulfur-sensitive reaction zone, typically using a sulfur-sensitive catalyst, which generally requires the use of high temperatures. The ability to pass the feed stream from one processing step to the other without the need to condense the feed is clearly economically beneficial.

Furthermore, by using the hydrocarbon product effluent as a purge gas to desorb the hydrogen sulfide from the adsorbent, which effluent will generally already be at an elevated temperature required for such desorption inasmuch as it will be coming from a sulfur-sensitive reaction step, it is not necessary to provide an external purge gas which must not only be heated but must also be in sufficient supply. Here, there is always a sufficient supply of purge gas since it is the feed stream itself which is being utilized and which is usually going to be at the proper desorption temperature.

So too, by not passing an externally provided purge gas through the system, there is less chance for any contamination of the hydrocarbon feed stream from foreign matter being introduced by such external purge gas.

Still further, by means of the present invention, whatever was removed in the adsorption zone is conveniently and efficiently returned to the hydrocarbon stream. This is particularly advantageous in situations where the necessity for sulfur removal is brought about simply by the sulfur-sensitivity of one or more processing steps but not because the presence of sulfur is objectionable in the end product. Thus, where the presence of sulfur can be tolerated in the end product, this specific embodiment of the present invention, which involves a temporary removal of such sulfur, would suffice to meet the needs of such a product and therefore the extra equipment and costs required for permanent sulfur removal are eliminated.

Moreover, in those situations where sulfur is objectionable in the end product, such sulfur, already in the form of hydrogen sulfide, can readily and inexpensively be removed from the cooled end product.

Generally, the specific embodiment of the present invention which is directed to sulfide removal may be characterized as follows:

A process for the conversion of hydrocarbon containing hydrogen sulfide in a reaction zone suitable for said conversion to produce a hydrocarbon product, said conversion being deleteriously affected by the presence of hydrogen sulfide, and said process being conducted under conditions suitable for the conversion including temperatures and pressures sufficient to maintain the hydrocarbon and hydrocarbon product essentially in the vapor phase comprising:

(a) passing the hydrocarbon containing hydrogen sulfide to at least one but not all of at least two adsorption zones at a temperature at least sufficient to maintain the hydrocarbon containing hydrogen sulfide essentially in the vapor phase, said adsorption zones containing a solid adsorbent having selectivity for the adsorption of hydrogen sulfide as compared to the hydrocarbon;

(b) withdrawing hydrocarbon having reduced hydrogen sulfide content from said at least one adsorption zone receiving the hydrocarbon and passing the hydrocarbon having reduced hydrogen sulfide content to the reaction zone to produce hydrocarbon product-containing effluent;

(c) passing at least a portion of the hydrocarbon product-containing effluent to at least one other of said adsorption zones not receiving the hydrocarbon but having previously adsorbed hydrogen sulfide as set forth in step (a) at a temperature at least sufficient to maintain the hydrocarbon product-containing effluent essentially in the vapor phase, whereby hydrogen sulfide is desorbed from the at least one other of said adsorptive zones to regenerate the at least one other of said adsorptive zones;

(d) withdrawing a hydrocarbon sulfide-containing, hydrocarbon product-containing effluent from the at least one other of said adsorptive zones; and (e) ceasing passing the hydrocarbon containing hydrogen sulfide to the at least one adsorption zone and regenerating said at least one adsorptive zone pursuant to step (c) and using at least one regenerated adsorption zone as the at least one adsorption zone for step (a).

In a more preferred embodiment, a particular advantageous application of the present invention is with the isomerization process briefly discussed above. By means of the present invention, it is now possible to integrate the hydrodesulfurization section of the process with the isomerization section so as to obtain a new, simplified, economical and efficient process which effectively eliminates much of the equipment previously needed when these two sections of the overall process were essentially run as independent processes.

Thus, in this new, simplified and integrated isomerization process, the hydrocarbone feed containing sulfur bearing components and/or nitrogen bearing compounds is first heated to form a vapor and then passed through a hydrotreating catalytic reactor in which the sulfur is converted to hydrogen sulfide and the nitrogen, if any, is converted to ammonia. The gaseous hydrocarbon feed, now containing sulfur in the form of hydrogen sulfide and nitrogen in the form of ammonia, leaves the hydrotreating reactor at substantially the same temperature as it entered and after some cooling, if desired, is introduced into at least one adsorption zone filled with an adsorbent which is capable of selectively adsorbing hydrogen sulfide and ammonia from the feed stream at the temperature and pressure conditions of the adsorber. Advantageously, water is also removed from the feed stream by many of these hydrogen sulfide/ammonia adsorbents which is beneficial to the subsequent isomerization step for the sulfur/nitrogen-sensitive catalyst used therein is to a lesser degree also sensitive to water.

The hydrocarbon feed, now freed of essentially all of its hydrogen sulfide and ammonia, is then subsequently introduced into the isomerization reactor, after some heating, if desired, where the hydrocarbons are isomerized. The isomerized hydrocarbon product effluent is then used to desorb at least one adsorbent bed which is laden with hydrogen sulfide and/or ammonia from a previous adsorption. As a result of the pressure drop and temperature rise in the isomerization reactor, the efficiency of the hydrocarbon isomerate gas as a purge gas is advantageously enhanced. It is noted, however, that it is not necessary in the present invention for the isomerization step to immediately follow the adsorption step, or similarly, for the desorption step to immediately follow the isomerization step. Any number of steps may be carried out upon the hydrocarbon effluent between the adsorption and isomerization steps and/or the isomerization and desorption steps.

The hydrocarbon isomerate product effluent, now containing the desorbed hydrogen sulfide and/or ammonia, may then, if desired, be condensed to eliminate excess hydrogen for recycle and then flashed or stabilized to remove hydrogen sulfide and/or ammonia.

As noted earlier, the adsorption/desorption step of the present invention is cyclic in nature. When one adsorber becomes substantially laden with hydrogen sulfide and ammonia, it is put on a desorption mode while a newly regenerated bed is generally simultaneously put on an adsorption mode by means of a series of valve changes directing the flow of the hydrocarbon feed stream.

As a result of the relatively short cycle times of the adsorption/desorption modes, the volume of the adsorbent required in these beds is very small compared to the volume of the isomerization reactor. The savings obtained by the elimination of extensive equipment from the conventional hydrodesulfurization/isomerization process, such as, a furnace heater, a steam stripper and its associated components, a recycle compressor, etc., far exceed the costs involved in adding the relative small hydrogen sulfide/ammonia adsorption beds.

Consequently, in its preferred embodiment, this invention does away with the need for a conventional hydrodesulfurization system while at the same time greatly simplifies the overall isomerization process. Economics and efficiency are improved not only by reducing the required capital expenditures for equipment but also by reducing the total operating costs of the overall process by the elimination of this equipment and by not having the need for the heating and cooling capacity as was required by the conventional technique.

More specifically, the process of the preferred embodiment of the present invention is characterized by the following:

A process for the hydrodesulfurization and isomerization of hydrocarbon feed containing at least four carbon atoms which feed contains at least sulfur and/or nitrogen components comprising:

(a) providing said hydrocarbon feed at a temperature and with sufficient molecular hydrogen to catalytically convert substantially all of the contained sulfur components to hydrogen sulfide and substantially all of the contained nitrogen components to ammonia, said temperature being at least sufficient to provide the hydrocarbon feed essentially in the vapor phase;

(b) passing the heated hydrocarbon feed of step (a) to a catalytic reaction zone containing a catalytically effective amount of catalyst, under hydrogen sulfide and ammonia forming conditions to provide substantially all of the contained sulfur and nitrogen in the hydrocarbon feed in the form of hydrogen sulfide and ammonia, respectively, and thereby produce a hydrogen sulfide and/or ammonia containing hydrocarbon feed;

(c) maintaining the hydrogen sulfide and/or ammonia containing hydrocarbon feed at a temperature at least sufficient to maintain the hydrogen sulfide and/or ammonia containing hydrocarbon feed essentially in the vapor phase and passing the hydrogen sulfide and/or ammonia containing hydrocarbon feed to at least one adsorption zone of a group of at least two adsorption zones wherein each adsorption is alternatingly subjected to adsorption and then desorption, wherein each adsorption zone contains solid adsorbent selective for the adsorption of hydrogen sulfide and ammonia as compared to the hydrocarbon feed, whereby a hydrocarbon feed having reduced hydrogen sulfide and/or ammonia content is provided;

(d) withdrawing the hydrocarbon feed having reduced hydrogen sulfide and/or ammonia from the at least one adsorption zone and passing it to an isomerization reaction zone containing catalytically effective amount of isomerizaton catalyst under isomerization conditions to provide an isomerate-containing effluent;

(e) withdrawing the isomerate-containing effluent from the isomerization reaction zone and passing it, while at a temperature at least sufficient to maintain the isomerate-containing effluent essentially in the vapor phase, to at least another one of said adsorption zones to desorb hydrogen sulfide and/or ammonia and provide a hydrogen sulfide and/or ammonia containing isomerate-containing effluent; and (f) withdrawing the hydrogen sulfide and/or ammonia containing isomerate-containing effluent from the at least another one of said adsorptive zones of step (e).

The present invention provides for a unique, simple and elegant method for temporarily removing a deleterious component from a fluid stream so as to have the deleterious component by-pass a processing step which is sensitive to this component in a most economical and efficient manner.

DETAILED DESCRIPTION OF THE INVENTION

Figure 1:
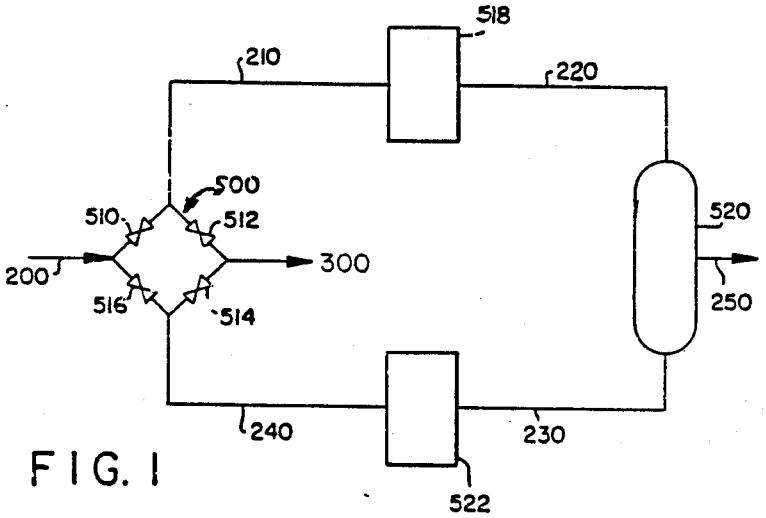
FIG. 1 is a schematic flowsheet of the broadest embodiment of the present invention showing two adsorbers and a processing step which is sensitive to a stream component including a valve control scheme which enables the cycling of the adsorbent beds.

Referring to FIG. 1, which depicts the present invention in its most simplified version and represents just one portion of an overall chemical process which contains a processing step which is sensitive to one or more components present in the stream to be processed, a fluid feedstream containing at least one component which is detrimental to at least one processing step within the process and at least one other component which is to have a processing operation performed on it in the sensitive processing step enters line 200. This fluid stream may be the feedstock to the overall chemical process which already contains the deleterious component or, alternatively, this fluid stream may be an intermediate stream in the overall process which has already been treated by one or more processing steps in which a deleterious component has been generated. In either case, this stream, prior to being introduced to the sensitive step, must be treated so as to remove the one or more deleterious components.

After entering line 200, the stream then enters valve assembly 500. In valve assembly 500, valves 510 and 514 are open and valves 512 and 516 are closed. The fluid stream containing the deleterious components passes through open valve 510 and enters adsorbent bed 518.

Adsorbent bed 518 contains an adsorbent which is selective for the one or more deleterious components contained within the stream as compared to the remaining stream constituents. Depending upon whether the fluid is a liquid or vapor and what the deleterious component is, the adsorbent is appropriately chosen also taking into account the temperature of the incoming feed stream. The temperature of the feed stream entering the adsorbent is most desirably at the temperature which is most optimum for the selective removal of the detrimental component, both in capacity and selectivity. However, as discussed earlier, due to the nature of this invention, it is possible to use adsorbents at temperatures which are not at optimum due to the rapid cycling of the adsorption/desorption phases.

The selection of a particular adsorbent for a specific application is well known to those skilled in the adsorption art. Generally, any adsorbent which is capable of selectively adsorbing the one or more deleterious components from the remaining constituents of the feed stream and which is capable of being regenerated by a fluid medium may be used as an adsorbent in the present invention. Adsorbents such as molecular sieves, silica gels, activated carbon, activated alumina, and the like, are all applicable to be used in the present invention. Reference is made to "Zeolite Molecular Sieves" by Donald W. Breck (John Wiley & Sons, 1974) which describes the use and selection of zeolite adsorbents and which is incorporated herein by reference.

Zeolite 3A adsorbent, for example, may be used to adsorb ammonia from hydrocarbon streams after such stream has been hydrodenitrified in a process which contains a processing step which is sensitive to nitrogen and its derivatives such as a reforming operation. Similarly, Zeolite 5A adsorbent may be used to adsorb carbon monoxide or carbon dioxide in light gas operations such as ammonia synthesis or urea manufacture in which the presence of $CO/CO_2$ is detrimental to the ammonia or urea formation catalysts. Activated carbon, for example, may be used to remove the condensibles from natural gas when membranes are used to separate methane from this gas which condensibles would be detrimental to the membrane.

Depending upon the particular overall process and the sensitive processing step involved, the adsorbent bed will be designed to contain enough adsorbent to remove substantially all of the at least one deleterious component or, alternatively, may allow a certain amount of breakthrough of deleterious component depending upon how much the sensitive step can tolerate.

It is understood, of course, that if the deleterious components in the feedstream are such that there is no one adsorbent that will readily selectively remove all of them, a combination of adsorbents may be used, either in admixture in one adsorbent bed or individually in a plurality of beds wherein the combined effect of these adsorbents is capable of removing substantially all of the deleterious components.

From adsorbent bed 518, an adsorption stage effluent is provided containing a reduced concentration of deleterious component. This adsorption stage effluent enters line 220 and ultimately is passed through the sensitive processing step shown diagrammatically in FIG. 1 as 520.

This sensitive step may comprise a chemical reaction, with or without a sensitive-type catalyst; a distillation step; an ion exchange resin; a non-regenerable sorbent or an adsorbent; a membrane separation unit; or the like.

After the adsorption stage effluent is subjected to the sensitive processing step, a product effluent stream is produced. At least a portion of this product effluent stream enters line 230 with the remainder entering line 250. Enough of the product effluent stream enters line 230 so that it can effectively be used as a purge medium to eventually regenerate adsorbent bed 522 which is in the desorption phase and is laden with deleterious component from a previous adsorption phase.

Although not shown in FIG. 1, the sensitive processing step may also produce secondary or waste effluent streams, the production of which is not the objective of the overall process which is to produce the product effluent stream which contains the component which was present in the feedstream and upon which an operation was performed in the sensitive processing step which component may be present per se in a more purified form or as a reaction product thereof. Thus, in a reforming operation, it is the reformate which is the product effluent stream and which, according to the present invention, is utilized as the purging medium for the spent adsorbent bed. In a distillation step, for example, it would be the purified product which would be used as the purging medium. Similarly, in an isomerization reactor, it would be the isomerate which acts as the regenerating medium for the spent adsorbent. Accordingly, as used herein, the product effluent stream is that stream which contains the component originally present in the feedstream and upon which an operation is performed in the sensitive processing step or which contains a reaction product of such component, the production of which is the objective of the overall process. In the process of the present invention, it is this product effluent stream, all or a portion thereof, which is used as the desorption medium for the spent adsorbent bed.

The desorption is carried out under desorption conditions which enables deleterious component to effectively be removed from the adsorbent and thereby regenerate the adsorbent for further use. Generally, if the product effluent stream is immediately contacted with the adsorbent to be regenerated, the temperature of the stream will usually be sufficient to provide the proper desorption temperature inasmuch as the sensitive processing step typically is carried out at elevated temperatures. However, if there are intervening steps between the sensitive step carried out at 520 and adsorbent bed 522 or, alternatively, if the temperature is not high enough, heating means (not shown) may be employed to raise the temperature of the product effluent stream to the proper desorption temperature.

The optium operating conditions for both the adsorption and desorption phases are well known to those skilled in the adsorption art and are readily ascertainable.

After adsorbent bed 522 is regenerated, a desorption stage effluent containing an increased concentration of deleterious component leaves this bed via line 240 and enters valve assembly 500 through valve 514 and then enters line 300 either as product or to continue to be further processed in the overall chemical process.

After a length of time, adsorbent bed 518 is laden with deleterious component and adsorbent bed 522 is regenerated. At this point, the valves in valve assembly 500 are adjusted such that valves 510 and 514 are closed and valves 512 and 516 are opened. In this manner, the flow of feedstream 200 is now reversed through the system such that it flows through line 240 into adsorbent bed 522 for adsorption of deleterious component and then into sensitive step 520 followed by regenerating bed 518 and ultimately leaving the system through valve 512 and line 300.

The length of time before an adsorption bed is switched to the desorption phase and vice versa is dependent upon the particular adsorbent, the deleterious component(s), the capacity of the adsorbent and the adsorption conditions, and will vary accordingly. Generally, an adsorption bed will be kept on the adsorption phase for a period of time which is less than the time it takes for breakthrough of the deleterious component to occur and can readily be determined by one skilled in the art.

Figure 2:
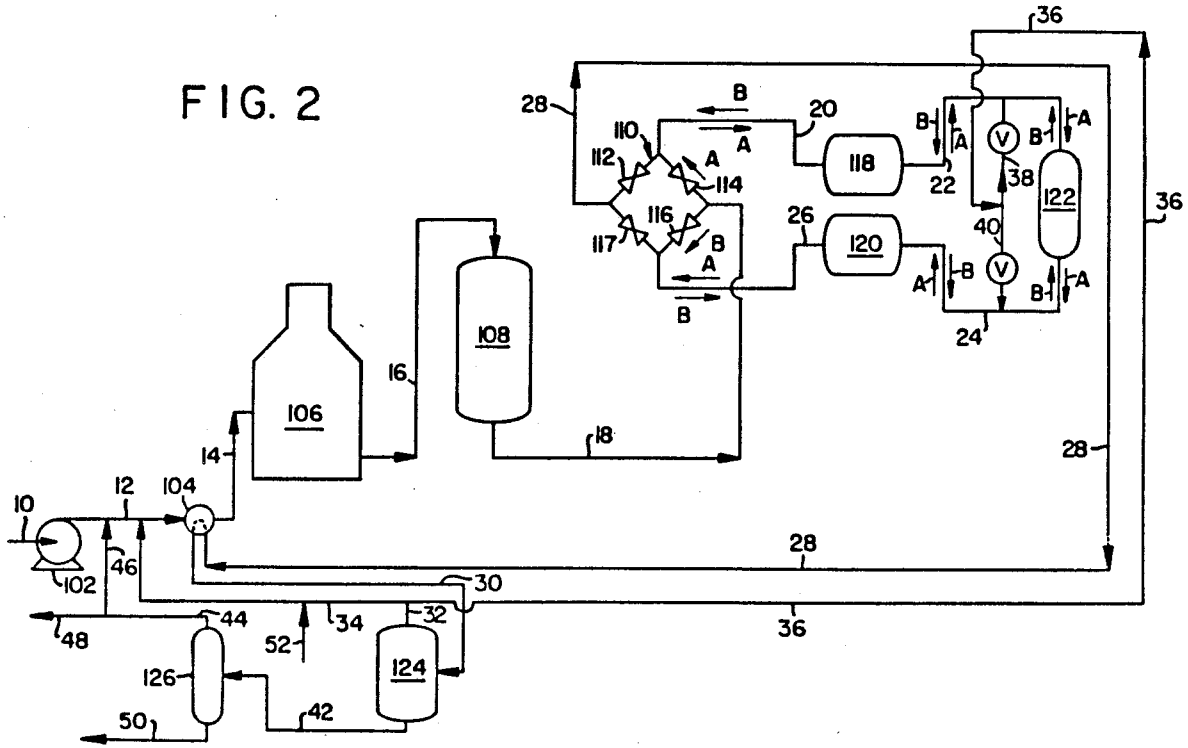
FIG. 2 is a schematic flowsheet of the preferred embodiment of the present invention wherein a hydrocarbon feed stream is subjected to an isomerization step.

While the following discussion will feature the preferred embodiment of the present invention as shown in FIG. 2, it is understood, as noted above, that the present invention is in no way limited to such an embodiment.

Referring now to FIG. 2, a liquid hydrocarbon feed stream containing sulfur, sulfur bearing compounds, nitrogen, and/or nitrogen bearing compounds is introduced through line 10 to pump 102 where it is first pumped to hear exchanger 104 via line 12.

In this isomerization process, the hydrocarbon feed stream usually contains at least five carbon atoms and is typically light straight run gasoline or light naphthas, natural gasolines, light hydrocrackate, or light reformate, which generally contain about 0 to 400 ppm of sulfur and 0–100 ppm, usually 0–10 ppm of nitrogen bearing compounds. In general, however, the composition of the feed stream is not critical to the present invention as long as the adsorbent is capable of selectively removing the hydrogen sulfide and/or ammonia from the remaining constituents of the hydrocarbon feed stream.

In heat exchangers 104, the feed stream is generally heated to a temperature in the range of from about 200° to 500° F., and preferably about 300° . to 450° F., before being introduced to heater 106 via line 14.

Heater 106 heats the hydrocarbon feed stream to the extent that there is phase change and the feed is converted to a vapor, which is required for the subsequent processing steps. Generally, the gaseous feed leaving heater 106 is at a temperature in the range of from about 500° to 650° F., and preferably about 550° to 600° F. and at a pressure of about 200 to 700 psi. Heater 106 is well known in the art and is conventionally utilized in a typical hydrodesulfurization/isomerization process.

From heater 106, the vaporous feed is conveyed via line 16 to hydrotreating reactor 108 in which essentially all of the sulfur and sulfur bearing compounds and nitrogen and nitrogen bearing compounds contained within the hydrocarbon feed stream are converted to hydrogen sulfide and ammonia, respectively, by reacting with hydrogen in the presence of a catalyst suitable for such purpose. Such a hydrotreating reaction is also well know to those in the art, is conventionally used in the typical hydrotreating/isomerization process, and is discussed in, for example, U.S. Pat. No. 4,533,529. Generally, the hydrogenation of the sulfur and nitrogen compounds within reactor 108 is carried out at a temperature of from about 500° to about 650° F. depending on the conditions and the source of hydrogen chosen. Useful catalysts are those containing metals of Groups VB, VIB, VIII and the Rare Earth Series of the Periodic Table defined by Mendeleff, published as the "Periodic Table of the Elements" in Perry and Chilton, *Chemical Engineers Handbook*, 5th Edition. The catalysts may be supported or unsupported, although catalysts supported on a refractory inorganic oxide, such as on a silica, alumina or silica-alumina base are preferred. The preferred catalysts are those containing one or more of the metals colbalt, molybdenum, iron, chromium, vanadium, thorium, nickel, tungsten (W) and uranium (U) added as an oxide or sulfide of the metal. Typical hydrotreating catalysts include Shell 344 Co/Mo (Shell Chemical Co., Houston, Tex.), C20-5, C20-6, C20-7, C20-8 Co/Mo hydrotreating catalysts (United Catalysts, Inc., Louisville, Ky.), and the like.

After the sulfur and/or nitrogen in the hydrocarbon feed stream is converted to hydrogen sulfide and ammonia, respectively, the stream exits reactor 108 via line 18 at substantially the same temperature as it entered, and is generally immediately introduced into at least one hydrogen sulfide/ammonia adsorption zone via valve assembly 110. If desired, however, it may be advantageous at this point to cool the hydrogen sulfide/ammonia containing hydrocarbon feed stream prior to its introduction into the adsorption zone in order to enhance the effectiveness of the adsorption step.

Valve assembly 110 is required so that it is possible to properly control the flow of the hydrocarbon feed stream to adsorber beds 118 and 120 in a manner which will allow either adsorption or desorption, depending upon whether the feed stream flows cocurrently or countercurrently through the adsorption beds.

It is noted that although the minimum of only two beds (118 and 120) are shown in the drawing, any number of beds may be utilized for the adsorption/desorption part of this process.

Generally, assuming that adsorption bed 118 has just been regenerated and is now ready for adsorption again, the path that the hydrocarbon feed stream would follow is shown by the arrows labelled "A" in the drawing. Valves 114 and 117 in the valve assembly would be in the open position whereas valves 112 and 116 would be closed. The hydrocarbon feed stream containing the hydrogen sulfide and/or ammonia would travel past valve 114, to line 20 and then to adsorption bed 118 in which it passes through cocurrently and hydrogen sulfide and/or ammonia contained within the feedstream is selectively removed by the adsorbent. The treated hydrocarbon feedstream, now having essentially all of its hydrogen sulfide and ammonia removed, is then passed through line 22 to isomerization reactor 122 in which the N-carbons are converted to their corresponding isomers in order to obtain higher octane values and form a hydrocarbon product-containing effluent, and more specifically, an isomerate. This isomerate is passed via line 24 to adsorbent bed 120 which is laden with hydrogen sulfide and/or ammonia from a previous adsorption cycle and which is now swept with the hydrocarbon product effluent in a countercurrent manner to regenerate bed 120 and to once again contain essentially all of the starting hydrogen sulfide and/or ammonia content. The hydrogen sulfide and/or ammonia laden hydrocarbon-product effluent stream then enters valve assembly 110 once again via line 26 and passes through valve 117 to line 28.

As was noted earlier, it is not necessary in the process of the present invention that the adsorption effluent immediately be introduced to the sensitive processing step (in this embodiment, the isomerization reaction), or that the effluent leaving the sensitive processing step immediately be used to desorb an adsorption bed. Thus, in the embodiment of FIG. 2, it may be desirable to first pass the adsorption effluent from adsorption bed 118 through a guard bed (not shown) containing zinc oxide, for example, to remove any traces of hydrogen sulfide that may still be present prior to having this stream enter the isomerization reactor. So too, after leaving the isomerization reactor, but before entering adsorption bed 120 for desorption thereof, the isomerate may first desirably be passed through a separator (not shown) such as a distillation column, molecular sieve adsorbent, and the like, to separate the isomers from the normal hydrocarbons that were not isomerized. The isomer stream may then be utilized to regenerate adsorption bed 120 while the normal hydrocarbons stream would advantageously be recycled back to the isomerization reactor for further processing.

After the adsorption cycle is completed and generally well before there is any hydrogen sulfide and/or ammonia breakthrough in the adsorption bed, the beds that are on the adsorption mode are switched to desorption and the beds that are on desorption are switched to adsorption. As mentioned earlier, due to the fact that the hydrogen sulfide/ammonia adsorbents are being utilized at high temperatures, which temperatures in the past have been used only for desorption, the capacity of these adsorbents is relatively low. Consequently, in order to still be able to use these adsorbents, the cycle times must be relatively short and an adsorbent bed can remain on the adsorption mode generally for about 0.5 to 6.0 hrs, preferably for about 1.0 to 2.0 hours. Once the adsorption cycle is complete and it is time for bed 118 to be desorbed and bed 120 to start the adsorption mode, as a result of opening valves 112 and 116 and simultaneously closing valves 114 and 117, respectively, the path of the feedstream now generally follows that shown by arrow "B" in the drawing, reversing its direction of flow through the adsorption zones and isomerization reactor to thereby flow cocurrently through bed 120 which is now on adsorption and countercurrently through bed 118 which is now on desorption.

Although this embodiment shows the reversal of feed flow through the isomerization reactor 122 as a result of cycling the adsorption beds, it is understood that the present invention also encompasses the embodiment where the flow of the hydrocarbon feedstream is continuous in one direction through the reactor 122 by means of proper arrangement of additional valves (not shown).

The hydrogen sulfide/ammonia adsorbent that is used in the adsorption beds must be capable of selectively adsorbing hydrogen sulfide and/or ammonia from the hydrocarbon stream and be able to withstand the temperature and pressure conditions existing within the adsorption beds. Generally, the temperature of adsorption is in the range of from about 200° to 500° F., and preferably about 300° to 450° F. at a pressure of about 200 to 700 psi.

Although the temperatures within the adsorption zone are substantially similar to those in the isomerization reactor, it may still be desirable to heat the hydrogen sulfide and ammonia free hydrocarbon feedstream prior to introducing it into the reactor so as to facilitate the proper isomerization reaction temperature.

Any adsorbent may be used in this embodiment as long as it is capable of selectively removing hydrogen sulfide and/or ammonia from the remaining constituents of the stream. The adsorbents which are particularly suitable in the process of this preferred embodiment of the present invention and which are capable of providing good hydrogen sulfide and/or ammonia removal at the high temperatures employed in the adsorption cycle are 4A zeolite molecular sieve and clinoptilolite.

The term "zeolite", in general, refers to a group of naturally occurring and synthetic hydrated metal alumino-silicates, many of which are crystalline in structure. There are, however, significant differences between the various synthetic and natural materials in chemical composition, crystal structure and physical properties such as X-ray powder diffraction patterns.

The structure of crystalline zeolite molecular sieves may be described as an open three-dimensional framework of $SiO_4$ and $A10_4$ tetrahedra. The tetrahedra are crosslinked by the sharing of oxygen atoms, so that the ratio of oxygen atoms to the total of the aluminum and silicon atoms is equal to two. The negative electrovalence of tetrahedra containing aluminum is balanced by the inclusion within the crystal of cations, for example, alkali metal and alkaline earth metal ions such as sodium, potassium, calcium and magnesium ions. One cation may be exchanged for another by ion-exchange techniques.

The zeolites may be activated by driving off substantially all of the water of hydration. The space remaining in the crystals after activation is available for adsorption of adsorbate molecules. This space is then available for adsorption of molecules having a size, shape and energy which permits entry of the adsorbate molecules into the pores of the molecular sieves.

Zeolite 4A is the sodium cation form of zeolite A and has pore diameters of about 4 angstoms. The method for its preparation and its chemical and physical properties are described in detail in U.S. Pat. No. 2,882,243, which is incorporated herein by reference.

Other adsorbents which are also applicable in this preferred embodiment of the present invention include those adsorbents which have a pore size of at least 3.6 angstroms, the kinetic diameter of hydrogen sulfide. Such adsorbents include zeolite 5A, zeolite 13X, activated carbon, and the like. Such adsorbents are well know in the art and are conventionally used for hydrogen sulfide/ammonia adsorption, albeit at much lower temperature than that used in this preferred embodiment.

As a precautionary measure, as noted earlier, it may be desirable to add a small conventional, zinc oxide guard bed (not shown) immediately after the adsorption zones and prior to the isomerization reactor to ensure against the possibility of any hydrogen sulfide residual breakthrough or a system upset.

The isomerization reactor 122 is a conventional isomerization reactor well known to those skilled in the art containing a catalytically effective amount of isomerization catalyst to provide the hydrocarbon effluent with enhanced isomer concentration. The isomerization reaction is generally carried out at a temperature in the range of from about 480° to 540° F. Generally, the temperature of the effluent leaving the reactor is somewhat higher than it was entering, about 5° to 40° F. higher. As a result of this temperature rise and the pressure drop across the reactor, the efficacy of the effluent as a purge gas is enhanced.

Although in this preferred embodiment, the sulfur and nitrogen sensitive processing step is the catalyst contained within the isomerization reactor, the present invention is applicable for any sulfur and/or nitrogen sensitive processing step wherein the sulfur is adsorbed by the specific cyclic adsorption system described above.

The product effluent now containing hydrogen sulfide and/or ammonia then passes via line 28 to be cooled in heat exchanger 104 and is then introduced via line 30 into separator 124. In separator 124, an overhead of excess molecular hydrogen is produced and a liquid hydrocarbon isomerate condensate. The hydrogen leaves separator 124 via line 32 and is then split into two streams via lines 34 and 36.

Line 34 provides hydrogen recycle to the feed at line 12 so as to have a stoichiometric excess of molecular hydrogen for the hydrogen sulfide and ammonia forming reactions. Additional makeup hydrogen may be provided via line 52.

Line 36 provides hydrogen, as a further embodiment of the present invention, which is combined via line 38 or line 40, respectively, with the isomerate to enhance the subsequent desorption step. Generally, about 0% to about 50 mole % of hydrogen is added to the hydrocarbon effluent.

The condensed hydrocarbon isomerate product leaving separator 124 is then introduced to stabilizer 126 via line 42. In stabilizer 126, the hydrocarbon isomerate is flashed so as to remove essentially all of the hydrogen sulfide and/or ammonia it contains as well as light end products such as $C_1$ to $C_4$ gases which leave the stabilizer as overhead via line 44. A portion of this overhead is recycled to the feed at line 12 via line 46 and the remainder is removed from the system via line 48. The final isomerate product is removed from stabilizer 126 via line 50.

Figure 3:
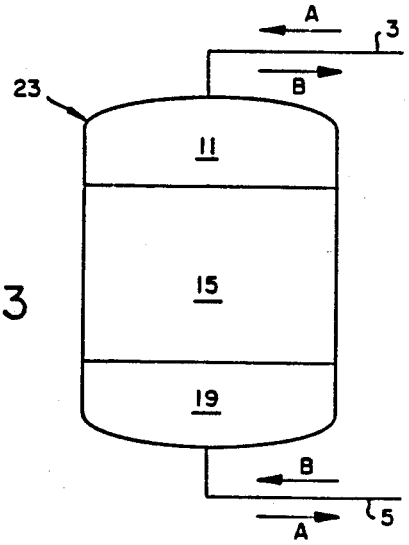
FIG. 3 is a schematic diagram showing an alternative embodiment of the present invention in which the adsorption zones and catalytic reaction zone are combined in one vessel.

Instead of using separate adsorbers and a caralytic reaction zone such as the isomerization reactor, as an alternative embodiment of the present invention, these elements of the process may be combined into one vessel as shown in FIG. 3. Here, adsorbent may be present in zones 11 and 19 of vessel 23 while a desirable catalyst for carrying out the sulfur and nitrogen sensitive processing step may be present in zone 15 of the vessel. The feedstream would enter either lines 3 or 5 and follow the flow path depicted by arrows "A" or "B", respectively, depending on whether the adsorbent zones are in the adsorption or desorption mode.

EXAMPLES

Example 1

A hydrocarbon feed containing 70 ppmw of sulfur (contained in a variety of sulfur bearing compounds) and 3 ppmw of nitrogen (contained as a variety of nitrogen bearing compounds) is to be isomerized. A feed quantity of 40 cc/min at a density of 0.65 g/cc (equivalent to 26 g/min at a introduced into a hydrotreating bed loaded with 300 grams of C20-8 Co/Mo hydrotreating catalyst, yielding a weight hourly space velocity (WHSV) of 5.2 for the hydrotreating reaction.

The stream, now containing hydrogen sulfide and ammonia, is then fed into an adsorber loaded with 400 grams of Zeolite 4A having a pore channel diameter of approximately 4 angstroms. A highly sensitive gas chromatagraph capable of resolving sulfur to below 0.1 ppmv is utilized to monitor the path of sulfur in the system. Sample taps are placed on the inlet and the exit of the adsorber beds.

The stream then enters an isomerization reactor after being heated to a temperature of 500° F. The isomerization reactor contains 945 grams of HS-10, an isomerization catalyst (Union Carbide Corporation, Danbury, CT), which results in a WHSV of 1.65 weight of feed/weight of catalyst per hour. The isomerate leaving the reactor at a temperature of 500° F. then enters the desorption bed.

In this example, a mild thermal swing is utilized to enhance the performance of the adsorption. The system parameters are as follows:

System pressure: 350 psig
Hydrotreating temp: 575° F.
Adsorption temp: 350° F.
Desorption temp: 500° F.
$H_2$/Hydrocarbon (mole basis): 1.0
Total cycle time (ads+des): 2 hours Measurement of the sulfur and nitrogen levels in the hydrotreater effluent demonstrates that all of the sulfur in the feed is converted to hydrogen sulfide and all of the nitrogen is converted to ammonia. During the adsorption portion of the cycle, no detectable amount of sulfur (hydrogen sulfide) or nitrogen (ammonia) is noted in the stream exiting the adsorber.

After the cycle is switched to desorption, the hydrogen sulfide and ammonia levels in the desorption effluent is monitored. An integration of the sulfur and nitrogen levels versus time is performed for both the adsorption feed and the desorption effluent. The comparison verifies that all sulfur and nitrogen entering with the adsorption feed leaves with the desorption effluent, confirming that no unsteady phenomena occurs.

Example 2

A hydrocarbon feed containing 410 ppmw of sulfur (contained in a variety of sulfur bearing compounds) is to be subjected to a reforming operation. A feed quantity of 40 cc/min at a density of 0.65 g/cc (equivalent to 26 g/min) is introduced into a hydrotreating bed loaded with 300 grams of C20-8 Co/Mo hydrotreating catalyst, yielding a WHSV of 5.2 for the hydrotreating reaction.

The stream, now containing hydrogen sulfide, is then fed into an adsorber loaded with 400 grams of Zeolite 4A having a pore channel diameter of approximately 4 angstroms. A highly sensitive gas chromatagraph capable of resolving sulfur to below 0.1 ppmv is utilized to monitor the path of sulfur in the system. Sample taps are placed on the inlet and the exit of the adsorber beds.

The stream then enters a reformer after being heated to a temperature of 900° F. and leaves the reformer at that temperature.

In this example, the naturally occurring temperature is utilized to enhance the performance of the adsorption. The system parameters are as follows:

System pressure: 350 psig
Hydrotreating temp: 575° F.
Adsorption temp: 575° F.

Desorption temp: 900° F.
$H_2$/Hydrocarbon (mole basis): 1.0
Total cycle time (ads+des): 2 hours Measurement of the sulfur level in the hydrotreater effluent demonstrates that all of the sulfur in the feed is converted to hydrogen sulfide. During the adsorption portion of the cycle, no detectable amount of sulfur (hydrogen sulfide) in noted in the stream exiting the adsorber.

After the cycle is switched to desorption, the hydrogen sulfide level in the desorption effluent is monitored. An integration of the sulfur level versus time is performed for both the adsorption feed and the desorption effluent. The comparison verifies that all sulfur entering with the adsorption feed leaves with the desorption effluent, confirming that no unsteady state phenomena occurs.

Example 3

One pound per hour of ammonia synthesis gas is to be reacted to form ammonia. The composition of the synthesis gas is the following:

$N_2$: 24.9 mole %
$H_2$: 74.9 mole %
CO: 500 ppmv
$CO_2$: 500 ppmv

An adsorber is utilized which contains 1.0 lbs of 5A molecular sieve. The adsorber is maintained at 100° F. which is the exit temperature of the bulk $CO_2$ removal stage which precedes the ammonia synthesis. The capacity for the carbon oxides on the 5A molecular sieve under these conditions is 0.1 weight percent. The total flow of carbon oxides to the bed is 0.0043 lbs/hr. Thus, by cycling the bed 5 times per hour, sufficient capacity is achieved to handle this level of carbon oxides in the feed. After becoming saturated with carbon oxides, the bed is purged with the ammonia product at 300° F. before it is cooled and sent to storage.

What is claimed is:

1. A process for the conversion of a hydrocarbon feedstream containing hydrogen sulfide and/or ammonia in a reaction zone suitable for said conversion to produce a hydrocarbon product, said conversion being deleteriously affected by the presence of said hydrogen sulfide and/or ammonia, and said process being conducted under conditions suitable for the conversion including temperatures and pressures sufficient to maintain the hydrocarbon and hydrocarbon product essentially in the vapor phase comprising:

(a) passing the hydrocarbon feedstream containing hydrogen sulfide and/or ammonia to at least one but not all of at least two adsorption zones at a temperature at least sufficient to maintain the hydrocarbon feedstream containing hydrogen sulfide and/or ammonia essentially in the vapor phase, said adsorption zones containing a solid adsorbent having a pore diameter less than or equal to 5 Angstroms and having selectivity for the adsorption of hydrogen sulfide and ammonia as compared to the hydrocarbon;

(b) withdrawing a hydrocarbon stream having reduced hydrogen sulfide and ammonia content from said at least one adsorption zone receiving the hydrocarbon feedstream and passing the hydrocarbon stream having reduced hydrogen sulfide and ammonia content to the reaction zone to produce hydrocarbon product-containing effluent;

(c) passing at least a portion of the hydrocarbon product-containing effluent to at least one other of said adsorption zones not receiving the hydrocarbon feedstream but having previously adsorbed hydrogen sulfide and/or ammonia as set forth in step (a) at a temperature at least sufficient to maintain the hydrocarbon product-containing effluent essentially in the vapor phase, whereby hydrogen sulfide and ammonia is desorbed from the at least one other of said adsorptive zones to regenerate the at least one other of said adsorptive zones;

(d) withdrawing a hydrogen sulfide and/or ammonia-containing, hydrocarbon product-containing effluent from the at least one other of said adsorptive zones; and (e) ceasing to pass the hydrocarbon feedstream containing hydrogen sulfide to the at least one adsorption zone and regenerating said at least one adsorption zone pursuant to step (c) and using at least one regenerated adsorption zone as the at least one adsorption zone for step (a) after a period of from 0.5 to 6.0 hours.

2. The process of claim 1, wherein at least a portion of the hydrogen sulfide and/or ammonia contained in the hydrocarbon was obtained by catalytically converting sulfur and/or nitrogen components in the hydrocarbon in the presence of excess molecular hydrogen.

3. The process of claim 2, wherein the hydrogen sulfide and/or ammonia-containing product effluent is condensed to form an overhead of excess molecular hydrogen and a condensate of liquid hydrogen sulfide and/or ammonia-containing product.

4. The process of claim 3, wherein the overhead of excess molecular hydrogen is recycled to be used for the catalytic conversion of the sulfur and/or nitrogen components in the hydrocarbon to hydrogen sulfide and ammonia, respectively.

5. The process of claim 3, wherein a portion of the overhead of excess molecular hydrogen is combined with hydrocarbon product-containing effluent prior to desorption of one of the adsorption zones.

6. The process of claim 1, wherein the temperature of the adsorbent during adsorption is in the range of from about 250° to 500° F.

7. The process of claim 6, wherein the temperature of the adsorbent during adsorption is in the range of from about 300° F. to 450° F.

8. The process of claim 1, wherein the adsorption zones contain 4A zeolite molecular sieve as an adsorbent.

9. The process of claim 1, wherein the adsorption zones contain clinoptilolite as an adsorbent.

10. The process of claim 1, wherein the adsorption zones contain zeolite 5A as an adsorbent.

11. The process of claim 1, wherein the adsorption zone must be regenerated after a period of from 1.0 to 2.0 hours.

12. A process for the hydrotreating and isomerization of hydrocarbon feed containing at least four carbon atoms which feed contains at least sulfur and/or nitrogen components comprising:

(a) providing said hydrocarbon feed at a temperature and with sufficient molecular hydrogen to convert catalytically substantially all of the contained sulfur components to hydrogen sulfide and substantially all of the nitrogen components to ammonia, said temperature being at least sufficient to provide the hydrocarbon feed essentially in the vapor phase;

(b) passing the hydrocarbon feed mixture of step (a) to a catalytic reaction zone containing a catalytically effective amount of catalyst, under hydrogen sulfide and ammonia forming conditions to provide substantially all of the contained sulfur components in the hydrocarbon feed mixture in the form of hydrogen sulfide and substantially all of the nitrogen components in the hydrocarbon feed in the form of ammonia and thereby produce a hydrogen sulfide and/or ammonia containing vaporous hydrocarbon stream;

(c) maintaining the hydrogen sulfide and/or ammonia containing hydrocarbon stream at a temperature at least sufficient to maintain the hydrogen sulfide and/or ammonia containing hydrocarbon stream essentially in the vapor phase and passing the hydrogen sulfide and/or ammonia containing hydrocarbon stream to at least one adsorption zone of a group of at least two adsorption zones wherein each adsorption zone is alternately subjected to adsorption and then desorption, wherein each adsorption zone contains solid adsorbent selective for the adsorption of hydrogen sulfide and ammonia as compared to the hydrocarbon stream, whereby a hydrocarbon stream having reduced hydrogen sulfide and/or ammonia content is provided;

(d) withdrawing the hydrocarbon stream having reduced hydrogen sulfide and/or ammonia from the at least one adsorption zone and passing it to an isomerization reaction zone containing a catalytically effective amount of isomerization catalyst which is deleteriously affected by the presence of hydrogen sulfide and/or ammonia under isomerization conditions to provide an isomerate-containing effluent;

(e) withdrawing the isomerate-containing effluent from the isomerization reaction zone and passing at least a portion of the effluent, while at a temperature at least sufficient to maintain the isomerate-containing effluent essentially in the vapor phase, to at least another one of said adsorption zones to desorb hydrogen sulfide and/or ammonia and provide a hydrogen sulfide and/or ammonia containing isomerate-containing effluent; and (f) withdrawing the hydrogen sulfide and/or ammonia containing isomerate-containing effluent from the at least another one of said adsorptive zones of step (e).

13. The process of claim 12, wherein the hydrocarbon feed contains a stoichiometric excess of molecular hydrogen for the hydrogen sulfide and ammonia forming reactions and the isomerization and thus the hydrogen sulfide and/or ammonia containing isomerization effluent also contains molecular hydrogen, wherein the hydrogen sulfide and/or ammonia containing isomerate-containing effluent from step (f) is subjected to conditions whereby substantially all of the hydrocarbon is condensed and an overhead containing the excess molecular hydrogen is provided, wherein at least a portion of the overhead is recycled for combination with the hydrocarbon feed in step (a).

14. The process of claim 13, wherein at least a portion of the overhead is combined with the isomerate-containing effluent and used to desorb an adsorption zone.

15. The process of claim 13, wherein the condensed hydrogen sulfide and/or ammonia containing isomerate-containing effluent is subjected to conditions which remove hydrogen sulfide and/or ammonia.

16. The process of claim 12, wherein the temperature of the adsorbent during adsorption is in the range of from about 250° F. to 500° F.

17. The process of claim 16, wherein the temperature of the adsorbent during adsorption is in the range of from about 300° F. to 450° F.

18. The process of claim 12, wherein the adsorption zones contain 4A zeolite molecular sieve as an adsorbent.

19. The process of claim 12, wherein the adsorption zones contain clinoptilolite as an adsorbent.

20. The process of claim 12, wherein the adsorption zones contain zeolite 5A as an adsorbent.

21. The process of claim 12, wherein the adsorption zone must be regenerated after a period of from 0.5 to 6.0 hours.

22. The process of claim 10, wherein the adsorption zone must be regenerated after a period of from 1.0 to 2.0 hours.

* * * * *

UNITED STATES PATENT AND TRADEMARK OFFICE

CERTIFICATE OF CORRECTION

PATENT NO. : 4,831,208

DATED : May 16, 1989

INVENTOR(S) : Andrew S. Zarchy

It is certified that error appears in the above-identified patent and that said Letters Patent is hereby corrected as shown below:

In Claim 1, col. 19, line 63, after the word "and" insert -- /or --.

In Claim 1, col. 19, line 66, after the word "and" insert -- /or --.

In Claim 1, col. 20, line 9, after the word "and" insert -- /or --.

In Claim 1, col. 20, line 17, after the word "sulfide" insert -- and/or ammonia --.

Signed and Sealed this

Sixth Day of March, 1990

*Attest:*

*Attesting Officer*

JEFFREY M. SAMUELS

*Acting Commissioner of Patents and Trademarks*